US007956706B2

(12) United States Patent
Blair et al.

(10) Patent No.: US 7,956,706 B2
(45) Date of Patent: Jun. 7, 2011

(54) MULTIBAND FILTER HAVING COMB-LINE AND CERAMIC RESONATORS WITH DIFFERENT PASS-BANDS PROPAGATING IN DIFFERENT MODES

(75) Inventors: Christine Blair, Salisbury, MD (US); Mostafa Mohamed Taher AbuShaaban, Runcorn (AU)

(73) Assignee: Filtronic PLC, West Yorkshire (GB)

( * ) Notice: Subject to any disclaimer, the term of this patent is extended or adjusted under 35 U.S.C. 154(b) by 361 days.

(21) Appl. No.: 11/574,985

(22) PCT Filed: Sep. 9, 2005

(86) PCT No.: PCT/AU2005/001370

§ 371 (c)(1),
(2), (4) Date: Feb. 10, 2008

(87) PCT Pub. No.: WO2006/026826

PCT Pub. Date: Mar. 16, 2006

(65) Prior Publication Data

US 2008/0246561 A1 Oct. 9, 2008

(30) Foreign Application Priority Data

Sep. 9, 2004 (AU) ..... 2004905144

(51) Int. Cl.
*H01P 1/20* (2006.01)

(52) U.S. Cl. ..... 333/202; 333/134; 333/235

(58) Field of Classification Search ..... 333/202, 333/126, 129, 134, 235
See application file for complete search history.

(56) References Cited

U.S. PATENT DOCUMENTS

| | | | | |
|---|---|---|---|---|
| 2,334,184 | A | 12/1943 | Carter | |
| 4,241,322 | A | 12/1980 | Johnson et al. | |
| 4,489,293 | A | 12/1984 | Fiedziuszko | |
| 5,329,687 | A * | 7/1994 | Scott et al. | 29/527.2 |
| 5,349,316 | A | 9/1994 | Sterns | |
| 5,793,271 | A | 8/1998 | Caceres Armendariz | |
| 5,805,033 | A * | 9/1998 | Liang et al. | 333/202 |
| 6,052,041 | A * | 4/2000 | Ishikawa et al. | 333/202 |
| 6,549,092 | B1 * | 4/2003 | Hattori et al. | 333/134 |
| 6,552,627 | B1 * | 4/2003 | Andoh et al. | 333/134 |

(Continued)

FOREIGN PATENT DOCUMENTS

GB 2276039 A 9/1994

OTHER PUBLICATIONS

Samantha Kerr, "Dual Band Dielectric Resonator Filters," BE (Hons) Thesis, The University of Queensland, published 2001, downloaded on Nov. 31, 2005 from http://innovexpo.itee.uq.edu.au/2001/projects/s369481/thesis.pdf.

(Continued)

*Primary Examiner* — Benny Lee
(74) *Attorney, Agent, or Firm* — Howard & Howard Attorneys PLLC

(57) ABSTRACT

A multiband filtering apparatus (40) for use in a communications system, said apparatus including a housing (21); a plurality of cavities (22.1, 22.2) disposed within said housing wherein each cavity includes a resonant structure, the resonant structure having at least one ceramic element (23.1, 23.2); at least one input port (27) coupled to a first resonator of said plurality of resonators; at least one output port (28) coupled to a second resonator of said plurality of resonators; and a closure member (25) adapted to engage said housing (21) and cap said cavities.

27 Claims, 12 Drawing Sheets

U.S. PATENT DOCUMENTS

| | | | | |
|---|---|---|---|---|
| 6,614,327 | B2 * | 9/2003 | Saito et al. | 333/202 |
| 2002/0041221 | A1 * | 4/2002 | Abdulnour | 333/202 |

OTHER PUBLICATIONS

Examination Report in Counterpart AU Application No. 2005282223, Sep. 3, 2009, Filtronic Pty Ltd.
Examination Report in Counterpart GB Application No. 0704432, Jan. 24, 2008, Filtronic Pty Ltd.
Examination Report in Counterpart GB Application No. 0704432, Jul. 16, 2008, Filtronic Pty Ltd.
Written Opinion and ISR in Counterpart PCT Application No. PCT/AU2005/001370, Nov. 11, 2005, Filtronic Pty Ltd.
Reply to Examination Report in Counterpart GB Application No. 0704432, Jul. 3, 2008, Filtronic Pty Ltd.
Reply to Examination Report in Counterpart GB Application No. 0704432, Sep. 28, 2008, Filtronic Pty Ltd.

* cited by examiner

MULTIBAND FILTER HAVING COMB-LINE AND CERAMIC RESONATORS WITH DIFFERENT PASS-BANDS PROPAGATING IN DIFFERENT MODES

BACKGROUND OF THE INVENTION

1. Field of the Invention

The present invention generally relates to communications filters. In particular although not exclusively the present invention relates to multiband cavity filters.

2. Discussion of the Background Art

Various forms of filters are employed in today's communications systems. Some of the more common types utilized are band pass, low pass, high pass and notch filters. A typical application of such filter types is within most household televisions and radios. Generally these devices employ band pass and low pass filters to select the desired station. Typically these tuning filters are constructed from conventional electronic components such as capacitors, inductors, resistors and operational amplifiers (in the case of active filtering).

While such filters are quite capable of handling transmissions in the AM, FM, VHF and selected UHF bands, they are not readily suitable for communications applications utilizing higher UHF frequency bands such as those used in microwave transmissions. At these higher frequency ranges some of the basic electrical characteristics of electronic components used in these filter constructions begin to degrade. This degradation alters the transfer characteristics of the filter causing distortion.

Accordingly, filtering in the higher UHF bands to EHF bands requires a different approach. One commonly used filter type for such higher bands, especially in high power communication systems is a cavity filter. Cavity filters are utilised in these high power systems due to their stability and their high Q factors.

One such use of a resonance cavity in a communication system is discussed in U.S. Pat. No. 2,337,184 entitled "Coupling Circuit", which relates to a circuit for coupling a plurality of sources such as plurality of radio frequencies to a single load. A rectangular cavity resonator is coupled to a first transmitter, a second transmitter and a load, in this case an antenna. The cavity allows the two transmitters to utilize the antenna simultaneously without interference. The two transmitters excite two fundamental modes within the cavity,. the first mode being at the frequency of the first transmitter and the second being at the frequency of the second transmitter. The antenna is coupled to the resonator via a dipole p and is positioned in such a manner that it is excited equally by modes thereby allowing both modes to propagate through an antenna A.

U.S. Pat. No. 5,349,316 entitled "Dual Bandpass Microwave Filter" discloses a dual port bandpass filter. The filter consists of at least one resonance cavity having two independent modes of operation at displaced frequencies. This provides the filter with two independent passbands within the desired frequency band. In order to produce the two passbands the filter requires the incoming waveguide to be orientated at an angle to the filter such that both TE and TM modes are excited within the cavity, particularly the $TE_{1,1,1}$ and $TM_{0,1,0}$ modes.

Yet another form of dual mode cavity filter is discussed in U.S. Pat. No. 5,793,271. The filter in this instance is composed of one or more dual-mode resonant cavities. Each cavity produces two resonant modes at two different frequencies. The two modes have essentially the same field distribution but are orthogonal to each other. The cavity further includes a first set and a second set of tuning elements to tune the respective modes to the desired frequency.

One problem with the above discussed filter types is that they can be quite large and cumbersome. Furthermore the frequency tuning of such filters is relatively dependent upon the coupling tuning. This is the case with the filter of U.S. Pat. No. 5,349,316 which requires the signal coupling to be orientated at a certain angle in order to induce the required modes. This is not always possible and therefore the operation of the filter may be impaired.

Accordingly it would be advantageous to provide a multiband filter which is less obtrusive and provides for quasi-independent frequency and coupling tuning as well as providing an improved tuning arrangement.

SUMMARY OF THE INVENTION

Disclosure of the Invention

In one aspect of the present invention there is provided a multiband filtering apparatus for use in a communications system, the apparatus including:

a housing;

a cavity disposed within the housing, the cavity including a resonant structure positioned within the cavity, the resonant structure including at least one ceramic element;

an input port and an output port, each port coupled to the resonant structure; and a closure member adapted to engage the housing and cap the cavity.

Preferably the resonant structure is positioned centrally within the cavity. Suitably the resonant structure is a multimode resonator, particularly where the filtering apparatus is for dual band filtering.

The ceramic element may be of annular, toroidal, cylindrical, elliptical or other suitable geometric configuration. Preferably the ceramic element is in the form of a puck. The puck may rest directly on the cavity floor. Alternatively the puck may be mounted on an appropriate support provided within the cavity. Preferably a TE01δ mode is used within the puck.

The resonant structure may also include at least one conductive element, suitably the conductive element is in the form of a post. The post may be positioned integral with or adjacent to the ceramic element. Preferably the post is aligned substantially co-axial with the ceramic element. Suitably the post extends upwardly from the floor of the cavity and terminates adjacent a rim of the cavity. Alternatively the post may terminate a predetermined height relative to the rim of the cavity. The post may also include a bore for receiving a tuning rod.

Preferably the cavity is dimensioned to produce at least one comb-line resonance mode. Most preferably the cavity is dimensioned to produce a comb-line resonance mode in the 900 MHz band and a TE01δ mode in the 1800 MHz band.

Suitably the input port and the output port are provided on opposing sides of the housing. The input and output ports may be a co-axial coupling, such as an F, N, SMA, 7/16 or other suitable type connector, or they may be a waveguide coupling such as a flange.

In another aspect of the present invention there is provided a multiband filtering apparatus for use in a communications system, the apparatus including:

a housing;

a plurality of cavities disposed within the housing wherein each cavity includes a resonant structure the resonant structure including at least one ceramic element;

at least one input port coupled to a first resonator of the plurality of resonators;

at least one output port coupled to a second resonator of the plurality of resonators; and a closure member adapted to engage the housing and cap the cavities.

Preferably each of the resonant structures is positioned centrally within a respective cavity. At least one of the resonant structures may be a multimode resonator.

Each of the ceramic elements may be of annular, toroidal, cylindrical, elliptical or other suitable geometric configuration. Preferably each ceramic element is in the form of a puck. The pucks may rest directly on the floor of the respective cavities. Alternatively one or more of the pucks may be mounted on an appropriate support provided within the respective cavities. Preferably a TE01δ mode is used within the pucks.

Suitably each of the resonant structures may also include at least one conductive element, suitably the conductive element is in the form of a post. Each post may be positioned integral with or adjacent to a ceramic element. Preferably each of the posts extends upwardly from the floor of the respective cavity and terminates adjacent a rim of the respective cavity. Alternatively one or more of the posts may terminate a predetermined distance from the rim of the respective cavity. Each post may also include a bore for receiving a tuning rod.

The cavities are suitably dimensioned to allow for the propagation of TM01δ and TE01δ modes.

Suitably the input port and the output port are provided on opposing sides of the housing. The input and output ports may be a co-axial coupling, such as an F, N, SMA, 7/16 or other suitable type connector, or the may be a waveguide coupling such as a flange.

In yet another aspect of the present invention there is provided a multiband filtering apparatus having a first filtering path and second filtering path, the apparatus including:

a housing;

a first set of cavities of disposed within the housing;

a first set of resonant structures wherein each of the resonant structures of first set of resonant structures are disposed within a respective cavity from the first set of cavities, each of the resonant structures including at least one ceramic element;

a first input port coupled to a first resonator of the first set of resonators;

a first output port coupled to second resonator of the first set of resonators;

a second set of cavities disposed within the housing;

a second set of resonant structures wherein each of the resonant structures of the second set of resonant structures are disposed within a respective cavity form the second set of cavities;

a second input port coupled to a first resonator from the second set of resonators; and a second output port coupled to a second resonator from the second set of resonators.

Suitably the first filtering path is provided through the first set of resonant structures, while the second filtering path is provided through the second set of resonant structures and at least one resonant structure from the first set.

At least one of the resonant structures from the first set of resonant structures may be multimode resonators. Each of the ceramic elements may be of annular, toroidal, cylindrical, elliptical or other suitable geometric configuration. Preferably each ceramic element is in the form of a puck. The pucks may rest directly on the floor of the respective cavities. Alternatively one or more of the pucks may be mounted on an appropriate support provided within the respective cavities. Preferably a TE01δ mode is used within the pucks.

Suitably each of the resonant structures from the first set of structures may also include at least one conductive element, suitably the conductive element is in the form of a post. Each post may be positioned integral with or adjacent to a ceramic element. Preferably each of the posts extends upwardly from the floor of the respective cavity and terminates adjacent a rim of the respective cavity. Alternatively one or more of the posts may terminate a predetermined distance from the rim of the respective cavity. Each post may also include a bore for receiving a tuning rod.

Preferably at least one of the resonant structures from the second set of resonant structures is a comb-line resonator.

Both the first and second sets of cavities are suitably dimensioned to allow for the propagation of TM01δ and TE01δ modes. Preferably the first set of cavities and second set of cavities are coupled together.

The input port and output port may be co-axial couplings, such as an F type connector, or the may be waveguide couplings such as a flange.

Suitably the housing, closure member and cavity or cavities (as the case may be) are formed from a conductive material, such as aluminium or other suitable metal. Alternatively the housing closure member and cavity may be formed from a suitable non-conductive material, such as plastics. Where the housing, closure member and cavity are formed from plastics material, the interior surfaces of the cavity are provided with a conductive coating.

The closure member may also include a frequency tuning arrangement, the tuning arrangement including at least one adjustable disk and at least one tuning rod. Suitably the adjustable disk is formed from a suitable metal such as aluminium and the tuning rod is a conductive threaded rod such as an M4 type screw.

Where the filter construction includes multiple cavities a coupling tuning arrangement may also be provided, the coupling arrangement including a floating disk and adjustment rod. Suitably the floating disk is formed from metal such as aluminium and the adjustment rod is a non-conductive threaded rod, resin screw, for example, an Ultem® resin screw.

BRIEF DESCRIPTION OF THE DRAWINGS

In order that this invention may be more readily understood and put into practical effect, reference will now be made to the accompanying drawings, which illustrate preferred embodiments of the invention, and in which like features are designated by the same reference numbers, and wherein.

Figure 7A:
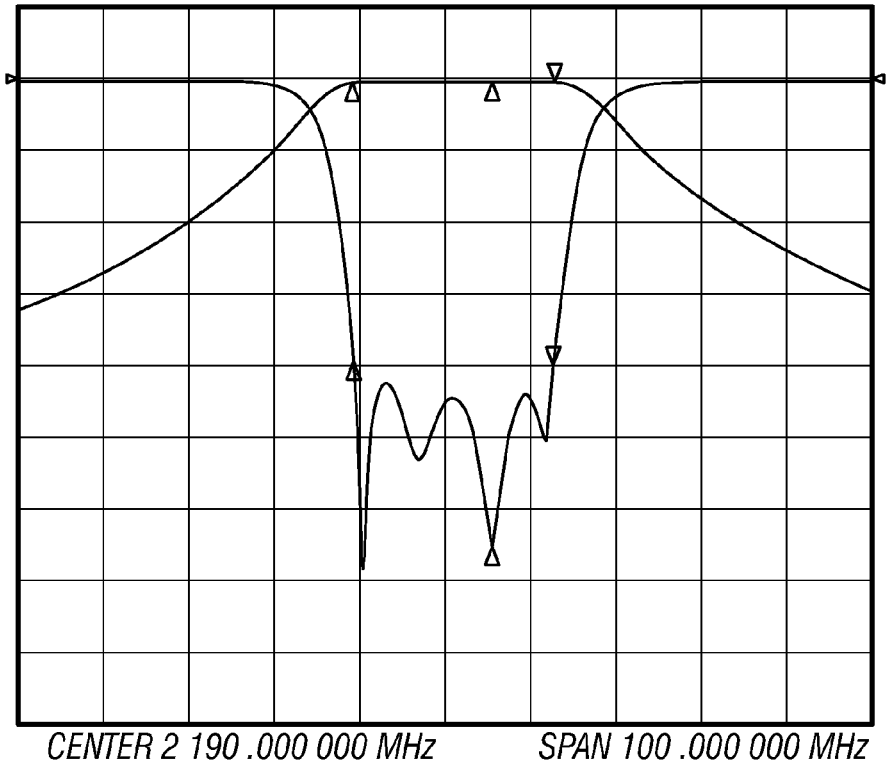
Figure 7B:
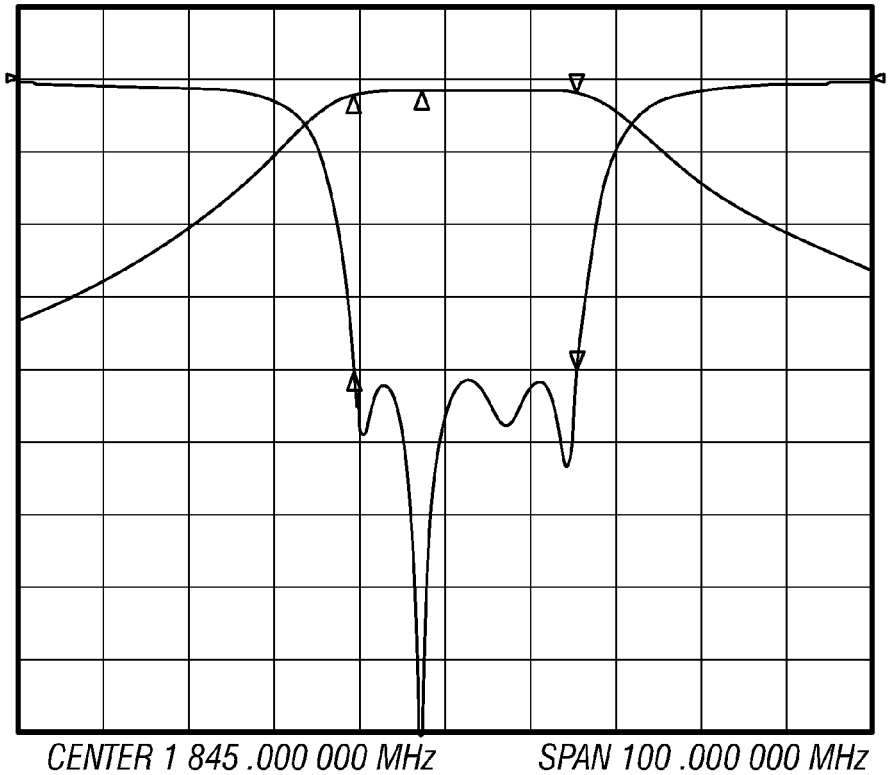
Figure 7C:
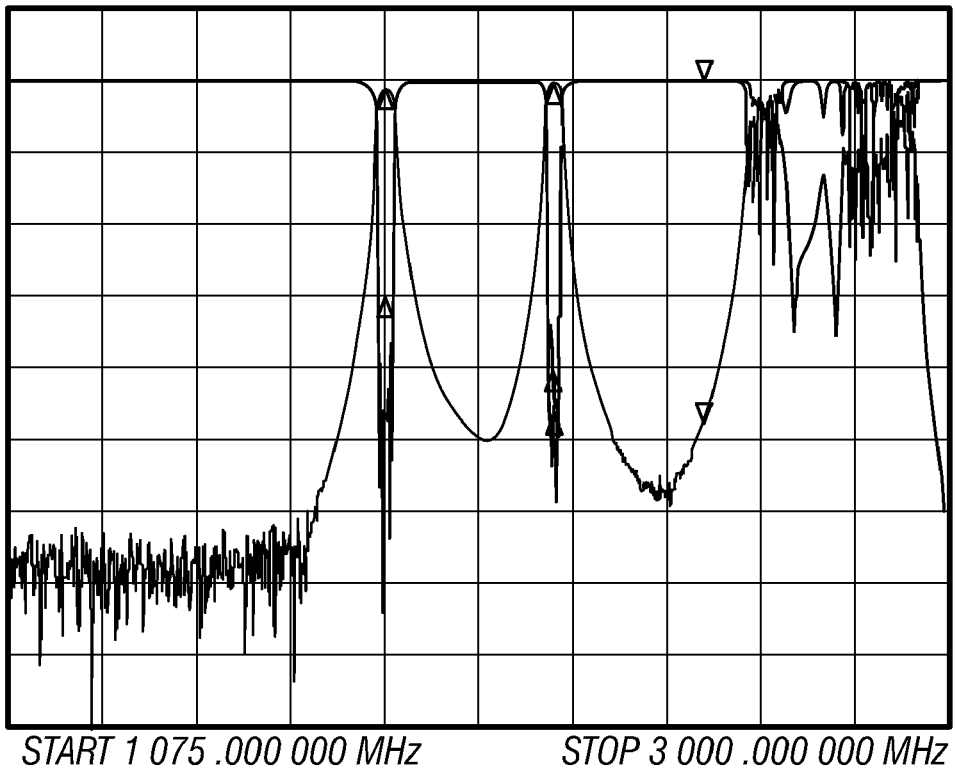
Figure 8A:
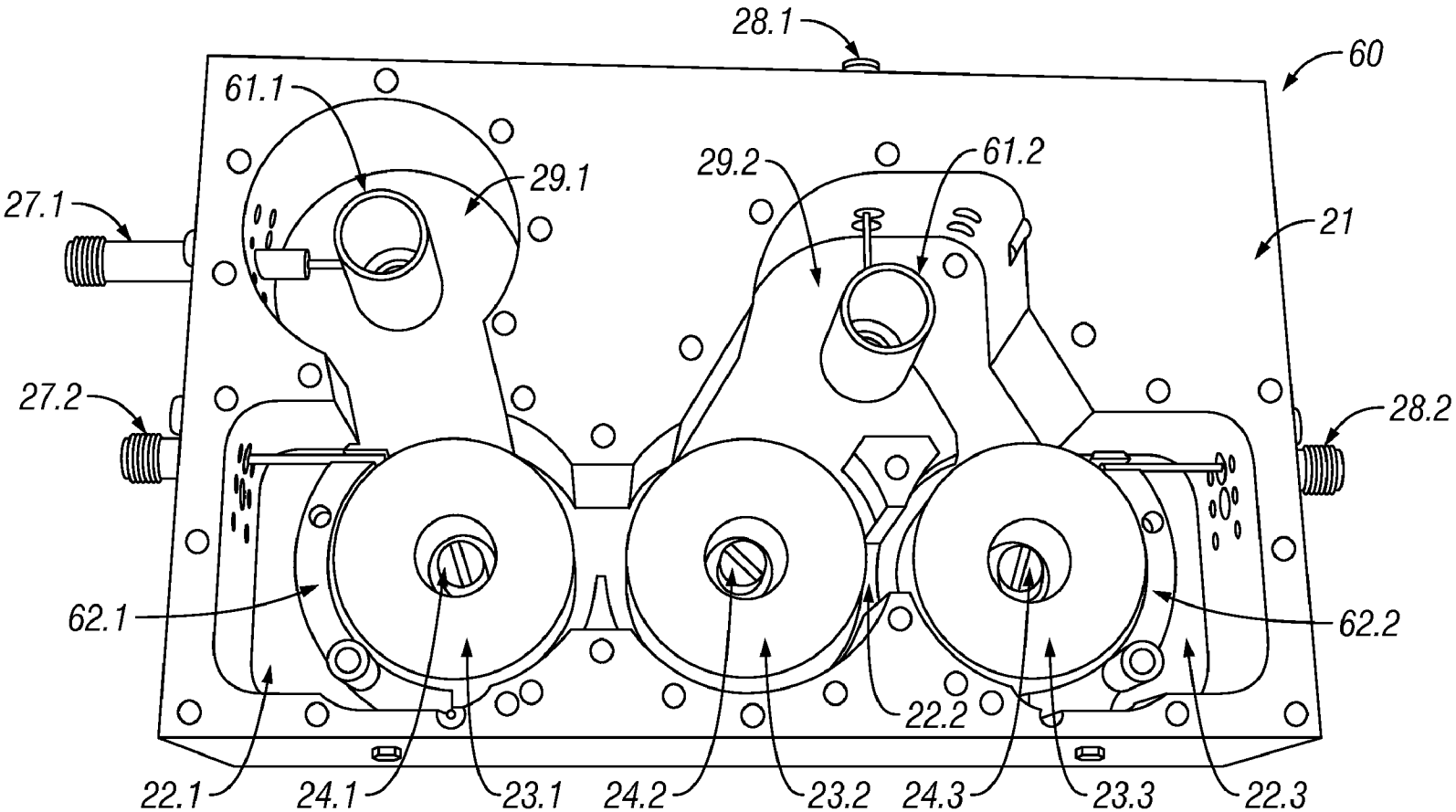
Figure 8B:
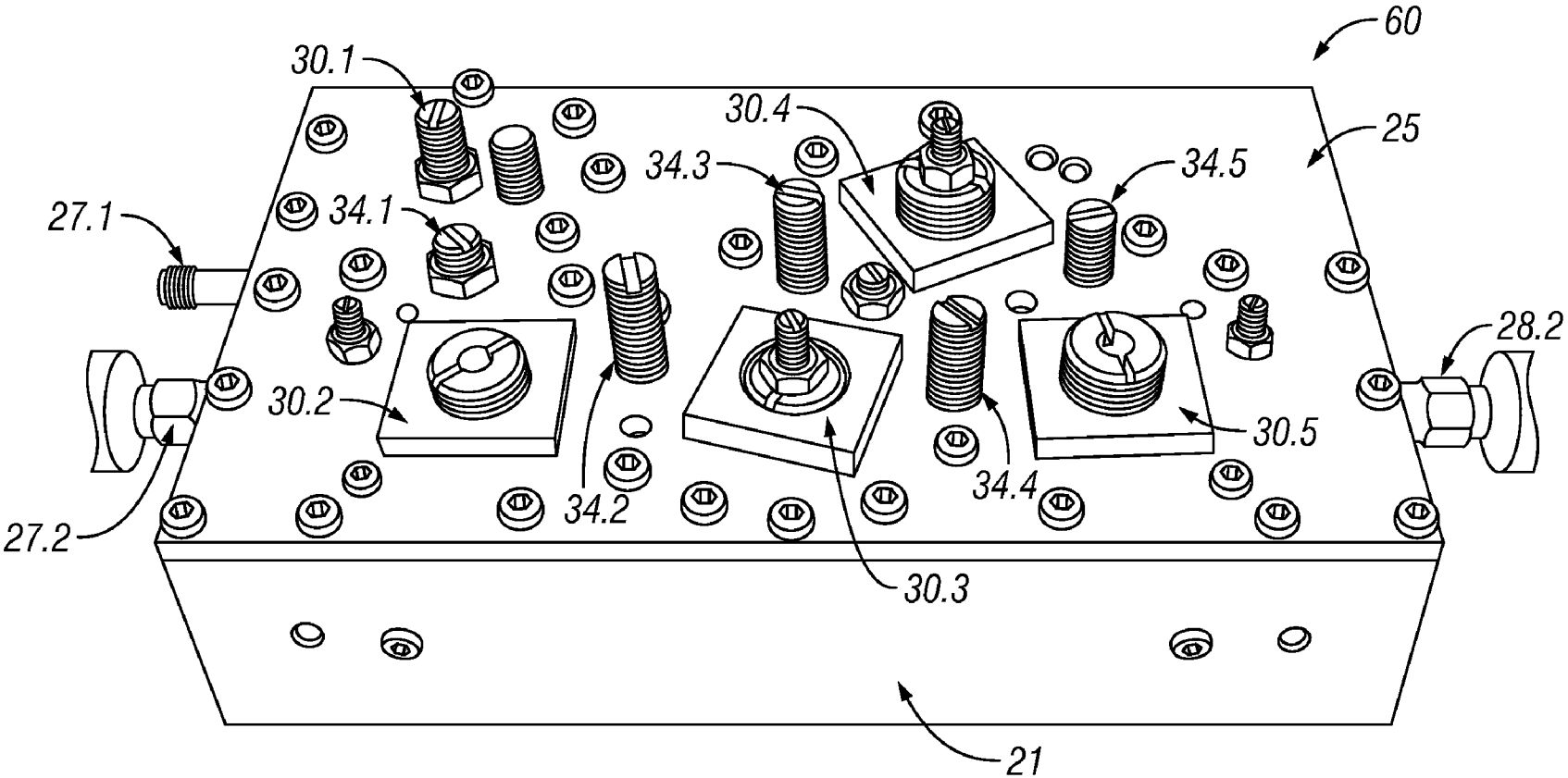
Figure 9A:
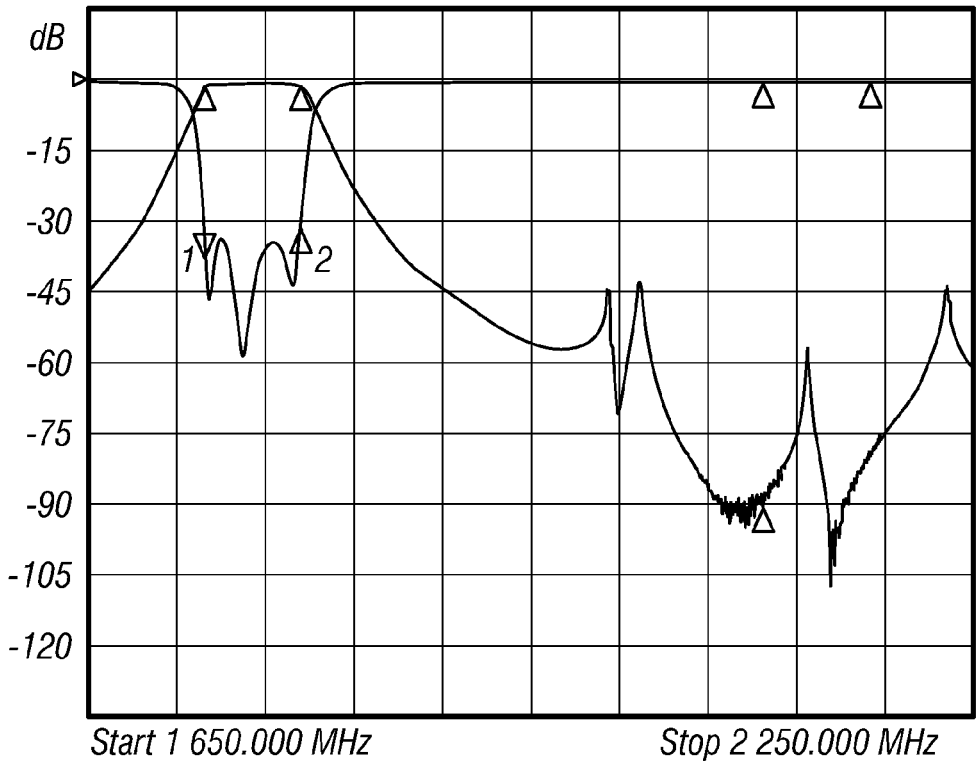
Figure 9B:
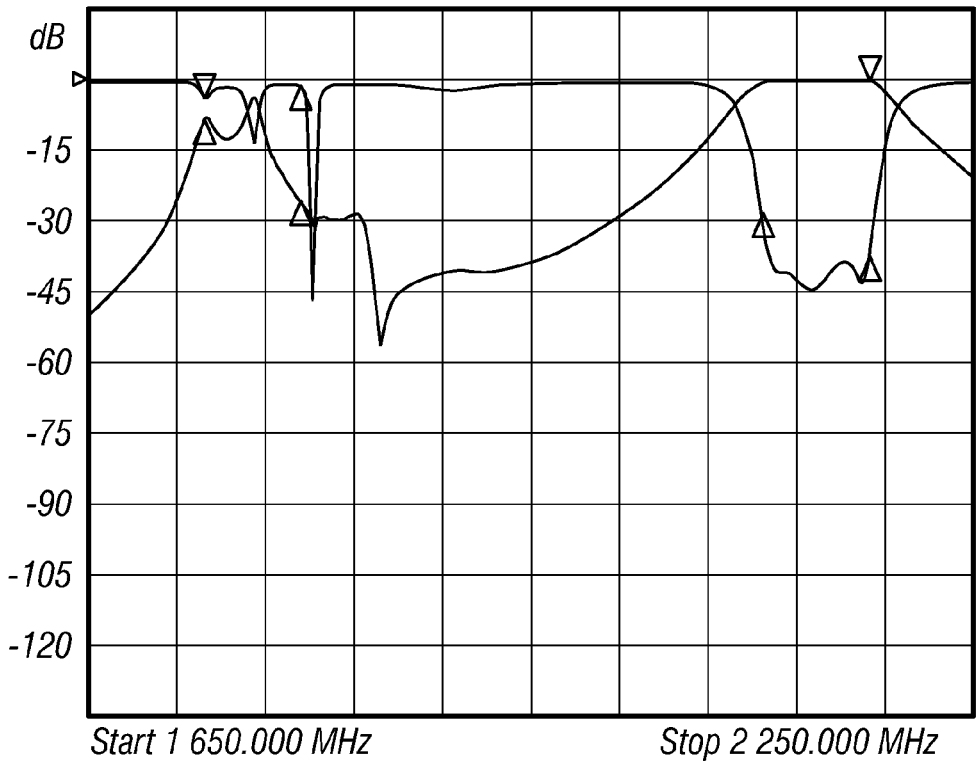

FIG. **6*a*** is a top view of a four section filter of a further embodiment of the present invention with the closure member removed;

FIG. **6*b*** is a top view of the filter of the further embodiment with the closure member fitted;

FIGS. 7*a*, 7*b* and 7*c* are plots of the frequency response of the filter of the further embodiment for the TM, TE and spurious modes, respectively;

FIG. 8*a* is a top view of still further embodiment of the present invention with the closure member removed;

FIG. 8*b* is a top view of the filter of FIG. 8*a* with the closure member fitted;

FIGS. 9*a* and 9*b* are plots of the frequency response of the filter of the still further embodiment for the TM and TE modes respectively; and FIGS. 10*a*, 10*b*, 10*c*, 10*d* and 10*e* are diagrammatic representations of the resonant structures for further embodiments of the present invention.

DETAILED DESCRIPTION OF PREFERRED EMBODIMENTS

Figure 1:
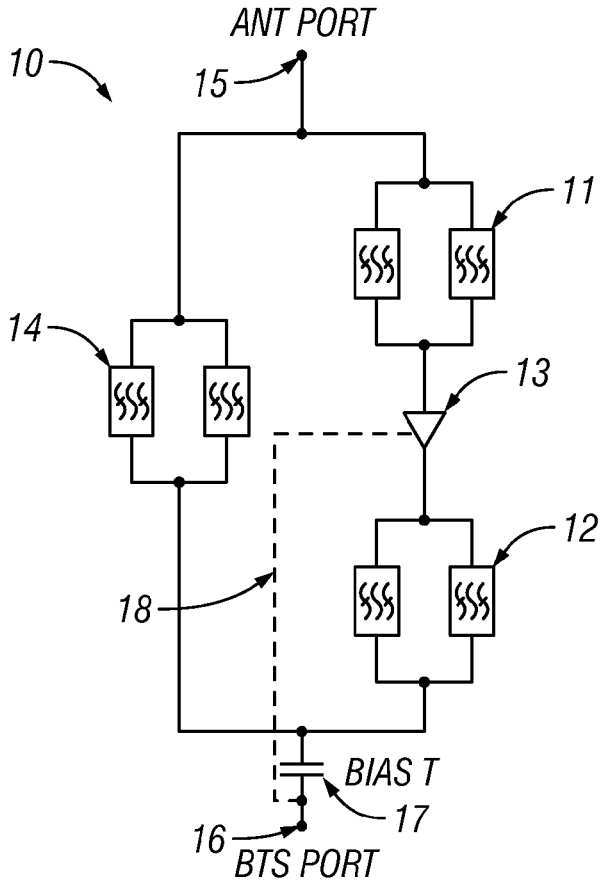
FIG. 1 is a block diagram of the layout of a typical masthead amplifier (MHA)

With reference to FIG. 1 there is illustrated the typical configuration for dual band masthead amplifier (MHA) 10 utilized in communications applications such as mobile telephony. The amplifier includes as antenna port (ANT Port) 15 and base station transceiver port (BTS port) 16. The receiving arm of the MHA is composed of a set of dual band filter banks 11, 12. The two banks are coupled together via a broadband low noise amplifier (LNA) 13. The amplifiers transmitting arm includes a dual band filter 14. A Bias-T 17 is coupled between the BTS port and the junction of the transmitting and receiving arms. The Bias-T may also be coupled via line 18 to the LNA 13. The Bias-T extracts incoming DC from the BTS transmission line and inserts the signals from the alarm and monitor circuits. Where the Bias-T is coupled to the LNA the extracted DC is used to provide the reference voltage $V_{cc}$ for the LNA. As previously mentioned, the size of such a MHA is very obtrusive and occupies a great deal of tower space which in turn adds to the cost of tower installation. The MHA is merely included by way of one example application of the filters of the present invention and other examples will be readily apparent to the skilled addressee.

Figure 2:
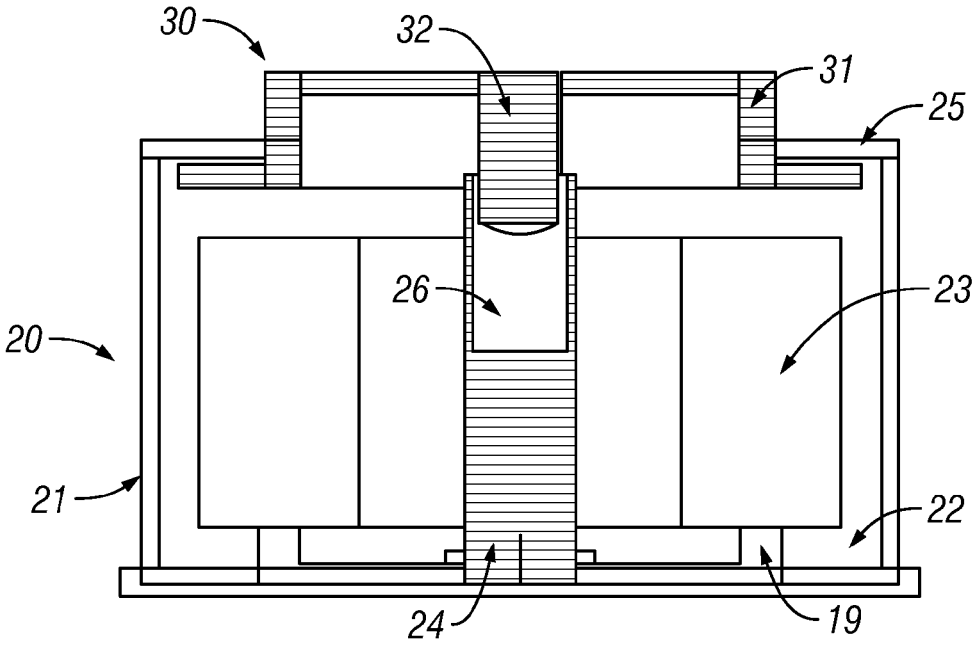
FIG. 2 is a cross sectional view of the filter layout according to one embodiment of the present invention.

FIG. 2 illustrates a cross sectional view of a multiband filter 20 according to one embodiment of the present invention. The multiband filter of FIG. 2 is based on the concept multimode resonators. The design illustrated in FIG. 2 is a comb-line TE filter layout. A cavity 22 is provided in housing 21, the cavity includes a resonant structure composed of a conductive post 24 and resonator 23. Post 24 extends upwardly from the cavity floor and terminates and terminates level with the cavity's upper rim. Post 24 may further include a bore 26 for receipt of a tuning screw 31 as discussed below. Resonator 23 is positioned within cavity 22 about the post 24 such that the resonator 23 and post 24 are substantially coaxial. In this particular example the resonator 23 is raised above the cavity floor via alumina support 19. To complete the filter construction closure member in this instance lid 25 is then positioned on the housing 21 to capping cavity 22. The lid 25 is secured in position on the housing by a series of screws. Lid 25 also provides a suitable mounting for the filters frequency tuning arrangement 30. The arrangement includes adjustable metal disc 31 and tuning screw 32.

Figure 3:
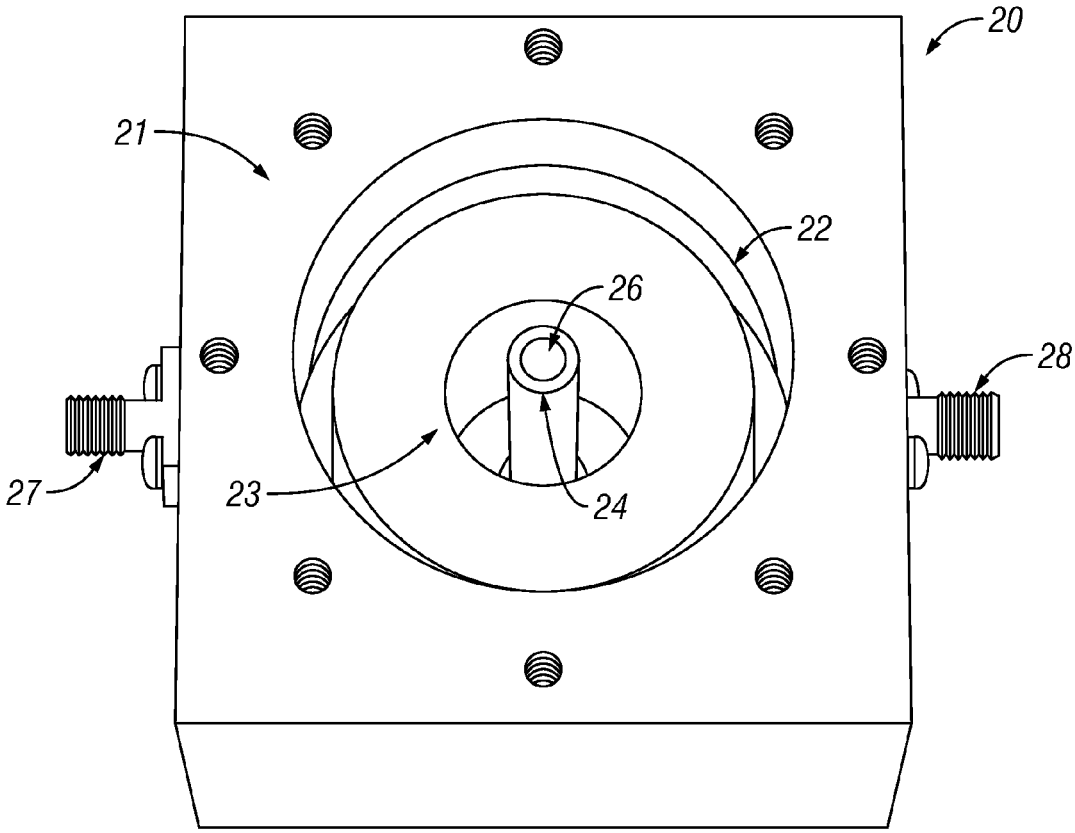
FIG. 3 is a top view of the filter of FIG. 2 with the closure member removed.

A top view of the filter 20 of FIG. 2 without lid 25 and tuning arrangement 30 attached is shown in FIG. 3. Resonator 23 is disposed with in cavity 22 about post 24 such that the resonator 23 is substantially coaxial with post 24. Also shown in FIG. 3 are the input port 27 and output port 28 for coupling the filter to the respective signal source and load.

In this particular example the resonator is a standard TE01δ puck. Positioning the puck within the cavity 22 substantially coaxial with the conductive post 24 lowers the comb-line mode below the TE01δ. As shown in FIG. 2, tuning arrangement 30 provides a further mechanism for adjusting the comb-line and TE filter modes in order to tune the filter to the desired frequencies. Lowering the metal disc 31 into the cavity tunes down the frequency of the comb-line mode and simultaneously tunes up the frequency of the TE01δ mode. While lowering the tuning screw 32 into the bore 26 tunes only the frequency of the comb-line mode and has no effect on the TE01δ mode.

In this instance the filter has been tuned as a dual band GSM900/GSM1800filter. The cavity is 40 mm deep and has a 38 mm diameter; sizing the cavity in this way produces a GSM900 filter with a bandwidth of 25 MHz filter and a GSM1800 filter with a bandwidth of 75 MHz.

The GSM900 band filter utilises a comb-line resonance mode, this mode offers the most compact construction for 900 MHz filter and a high spurious response.

For the GSM 1800 band filter the TE01δ mode is utilized. As the comb-line fields of the GSM900 filter are similar to the TM01δ mode accordingly the fields of the GSM900 filter are orthogonal to the TE01δ mode. Employing the TE01δ mode for the GSM 1800 filter gives the largest mode separation in frequency between the two filters and good spurious response.

Figure 4:
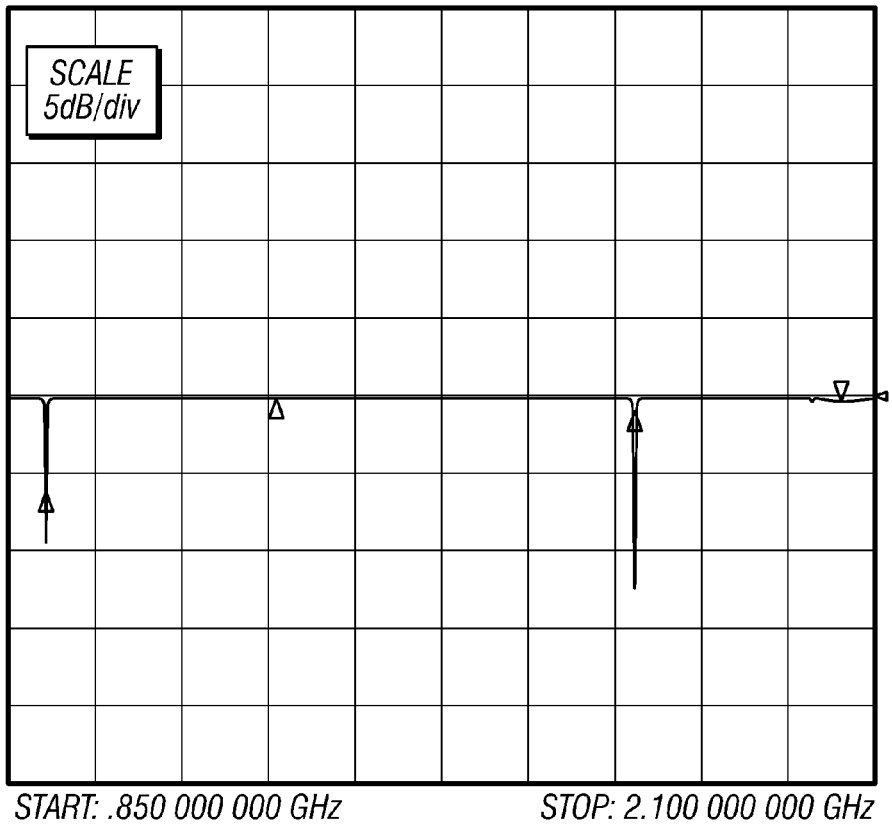
FIG. 4 is a plot of the frequency response of the filter layout of FIGS. 2 and 3.

The above discussed filter construction results in a 900 MHz filter with an estimated Q of 2800 and 1750 MHz filter with an estimated Q of 6000. The spurious modes only begin to appear at 2.05 GHz as shown in FIG. 4, which is a plot of the frequency response of the GSM900/GSM1800 filter.

Figure 5:
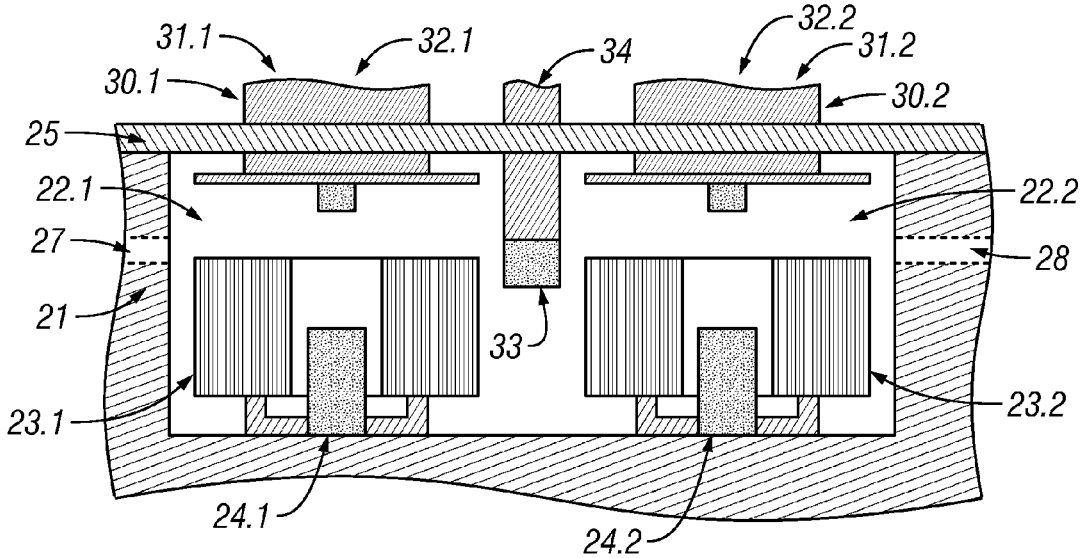
FIG. 5 is a cross sectional view of a dual cavity filter of another embodiment of the present invention.

FIG. 5 illustrates a cross sectional view of a dual cavity filter having an input port 27 and an output port 28 according to another embodiment of the present invention. Cavities 22.1 and 22.2 are disposed within housing 21. Each cavity includes a resonant structure, the combination of conductive posts 24.1 and 24.2 and resonators 23.1 and 23.2, the resonators being aligned substantially coaxial with the respective conductive post. Each of the posts may also include a bore (not shown) for receiving a tuning screw as discussed below. To complete the filter construction closure member 25 is positioned on the housing 21 thereby capping cavities 22.1 and 22.2. The filter in this instance is capable of implementing TM01δ and TE01δ modes respectively. While it would seem that the modes implemented by this arrangement of the GSM 900/1800 filtering apparatus discussed above it would be appreciated by a person skilled in the art that the combined mode within the GSM 900/1800 filter may be a TM01δ mode. Accordingly in each instance the filtering apparatus of the present invention suitably employs orthogonal modes.

Frequency tuning arrangements 30.1 and 30.2 are also provided for the respective cavities 22.1 and 22.2. Each tuning arrangement includes an adjustable disk 31.1 and 31.2 and tuning screws 32.1 and 32.2. Varying the depth of metal disks 31.1 and 31.2 tunes the frequency of the TE01δ and TE01δ modes within their respective cavities 22.1 and 22.2 without affecting the modes of the neighboring cavity. While varying the depth of tuning screws 32.1 and 32.2 within post bores 26.1 and 26.2 tunes only the TE01δ mode of the respective cavities coupling between each cavity.

In order to control the mode coupling between each cavity of the filter a floating disk 33 is provided. The position of the floating disk within the filter is controlled via tuning rod 34. Varying the depth of the floating disk 33 within the filter between the cavities varies the amount of TE01δ coupling between the respective cavities. The level of TM01δ coupling between the respective cavities is controlled via a further adjustable rod 34 varying the depth of the rod 34 varies the amount of TM01δ coupling between the respective cavities without effecting the TE01δ coupling. The advantage of this structure is that the frequency tuning and coupling tuning remain quasi independent.

Figure 6A:
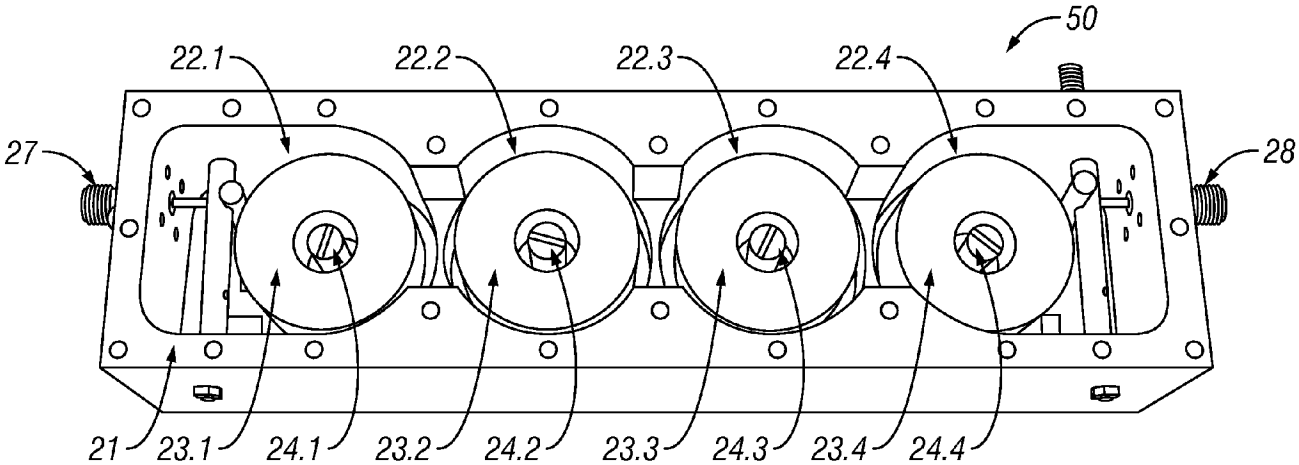

With reference to FIG. 6*a*, there is shown a four section filter 50 having an input port 27 and an output port 28 according to yet another embodiment of the present invention. The filter construction in this case includes multiple cavities 22.1, 22.2, 22.3 and 22.4 provided within housing 21. A common signal input 27 and output 28; thus the filter is a dual diplexed device.

Each of the four cavities includes a centrally disposed conductive post 24.1, 24.2, 24.3 and 24.4 and a resonator 23.1, 23.2, 23.3 and 23.4, respectively. Each of the resonators 23.1, 23.2, 23.3 and 23.4 is positioned within its respective cavity 22.1, 22.2, 22.3 and 22.4 and aligned substantially coaxial with the corresponding post 24.1, 24.2, 24.3 and 24.4.

Figure 6B:
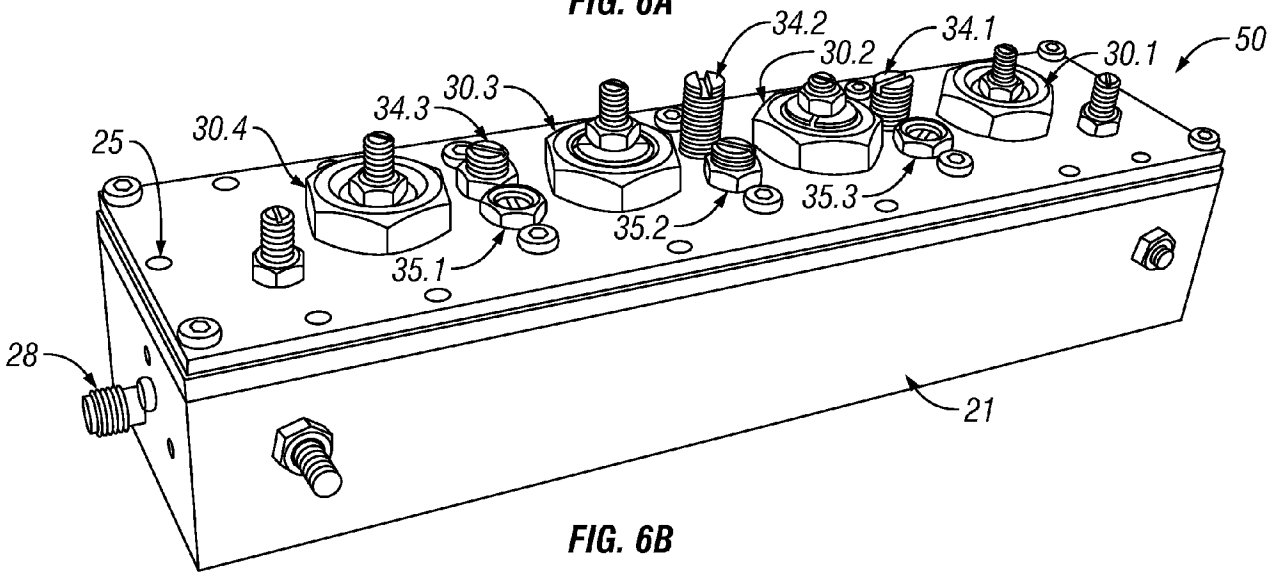

To complete the filter construction closure member 25 is positioned on housing 21 thereby capping cavities 22.1, 22.2, 22.3 and 22.4 (not shown). Shown in FIG. 6*b* are frequency tuning arrangements 30.1, 30.2, 30.3, and 30.4 for the respective cavities 22.1, 22.2, 22.3 and 22.4 and output port 28. The construction of the frequency tuning arrangements are the same as those discussed above, namely each includes an adjustable metal disk and tuning screw. Varying the depth of metal disk and screws within the respective cavities tunes the filter to the desired frequency ranges.

Coupling between each cavity of the filter is also implemented in a similar manner to that discussed above. Floating disks 33.1 to 33.3 (not shown) are provided between neighboring cavities. Varying the depth at which the floating disk is positioned within the filter 50 varies the level of TE01δ coupling between the respective cavities. While varying the depth of rods 35.1, 35.2 and 35.3 within the filter 50 varies the level of TM01δ coupling between the respective cavities. Adjustment of the floating disk is provided via rods 34.1, 34.2 and 34.3 as can be seen from FIG. 6*b*. The varying heights of the tuning rods 34.1, 34.2 and 34.3 indicate that the floating disks have been adjusted to various depths along the length of the filter to provide the desired level of TE01δ coupling. Similarly rods 35.1, 35.2 and 35.3 have been adjusted to various depths along the length of the filter to provide the desired level of TM01δ coupling.

In this particular example the TE01δ filter was tuned at 2190 MHz with a bandwidth of 15 MHz, and the TM01δ filter was tuned to a frequency 1845 MHz with a bandwidth of 20 MHz bandwidth, as shown in frequency response diagrams of FIGS. 7*a* and 7*b*, respectively. The filters spurious response is shown in FIG. 7*c*, with the spurious modes beginning to appear at 2.5 GHz.

With the four section filter of FIGS. 6*a* and 6*b* it proved difficult to achieve a high input coupling bandwidth within the same cavity. FIGS. 8*a* and 8*b* show one possible construction of a filter 60 employed to increase the input coupling bandwidth. Filter 60 is provided with two sets of cavities for the transmission of the TE01δ and TM01δ modes. Thus unlike the previous embodiments the filter is not diplexed. The diplexing function in this example is dealt with via the transmission lines.

As shown in FIG. 8*a*, the TE filter is a 3 section filter while the TM filter is a 4 section filter. The TE filter is of a similar construction to the 4 section filter discussed above. The TE filtering is provided through a first set of resonant structures the combination of resonator 23.1, 23.2 and 23.3 and conductive posts 24.1, 24.2 and 24.3. Each resonator is positioned within a respective cavity from a set of cavities 23.1, 23.2 and 23.3 such that said resonator is substantially co-axial with the corresponding conductive post 24.1, 24.2 and 24.3.

The TM coupling at input port 27.1 and output port 28.1 is provided via tapped resonators 61.1 and 61.2 centrally disposed within the second set of cavities 29.1 and 29.2. The TE coupling is provided through horizontal posts 62.1 and 62.2 at input port 27.2 and output port 28.2.

The structure of the present TM filter differs slightly from the examples discussed above. In this example the TM filter employs a second set of resonant structures in this case two standard comb-line resonators 61.1 and 61.2 centrally disposed with the respective cavities 29.1 and 29.2 of the second set of cavities. Resonators 61.1 and 61.2 are couple to input and output ports 27.1 and 28.1 via a direct tapping.

The TM filtering is then provided through the input resonator 61.1 through two sections of the TE filter resonator and post combinations 23.1, 24.1 and 23.2, 24.2 to output resonator 61.2.

FIG. 8*b* shows the filter 60 with closure member 25 fitted to housing 21 for capping the first and second set of cavities. As with the above embodiments, both frequency tuning and coupling tuning arrangements are also provided for the respective cavities. The frequency tuning arrangements 30.1, 30.2, 30.3, 30.4 and 30.5 of similar construction to that discussed above. Each arrangement includes an adjustable tuning disk and tuning screw. Similarly the coupling tuning arrangement employed is the same as that discussed above. With floating disks provided between neighboring cavities the position of each disk within the filter being varied via the respective tuning rods 34.1, 34.2, 34.3, 34.4 and 34.5.

In this instance the depths of the various elements of the frequency and coupling arrangements have been adjusted to provide a TM filter tuned to a frequency of 1750 MHz and having a bandwidth of 75 MHz, and TE filter tuned to a frequency of 2140 MHz with a bandwidth of 60 MHz. A plot each filter's frequency response is shown in FIGS. 9*a* and 9*b* respectively.

Figure 10A:
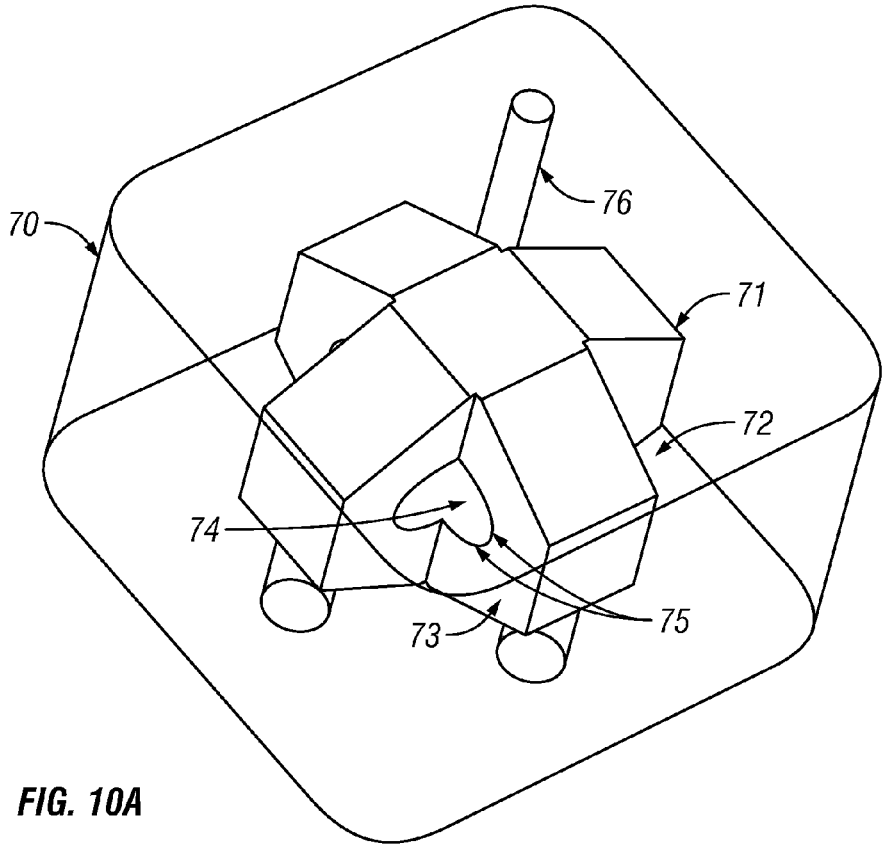

FIG. 10*a* represents one embodiment of the resonant structure 70 for the present invention. In this particular example the body of the ceramic element 71 is of cruciform configuration with both the top surface 72 and bottom surface 73 of the each arm member being beveled. The body also includes a central void 74 with one or more curved surfaces 75. Preferably the internal surfaces of the central void 74 are composed of two intersecting cylindrical bores. In this instance the resonant structure also includes a conductive post 76 positioned adjacent the ceramic element 71.

Figure 10B:
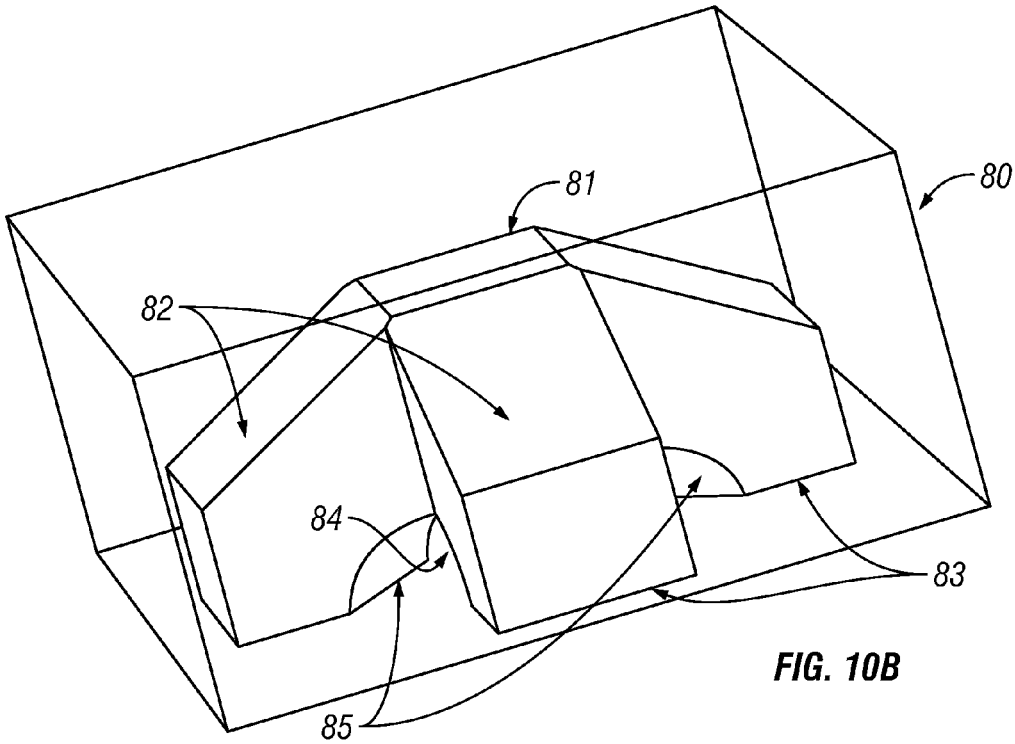
Figure 10C:
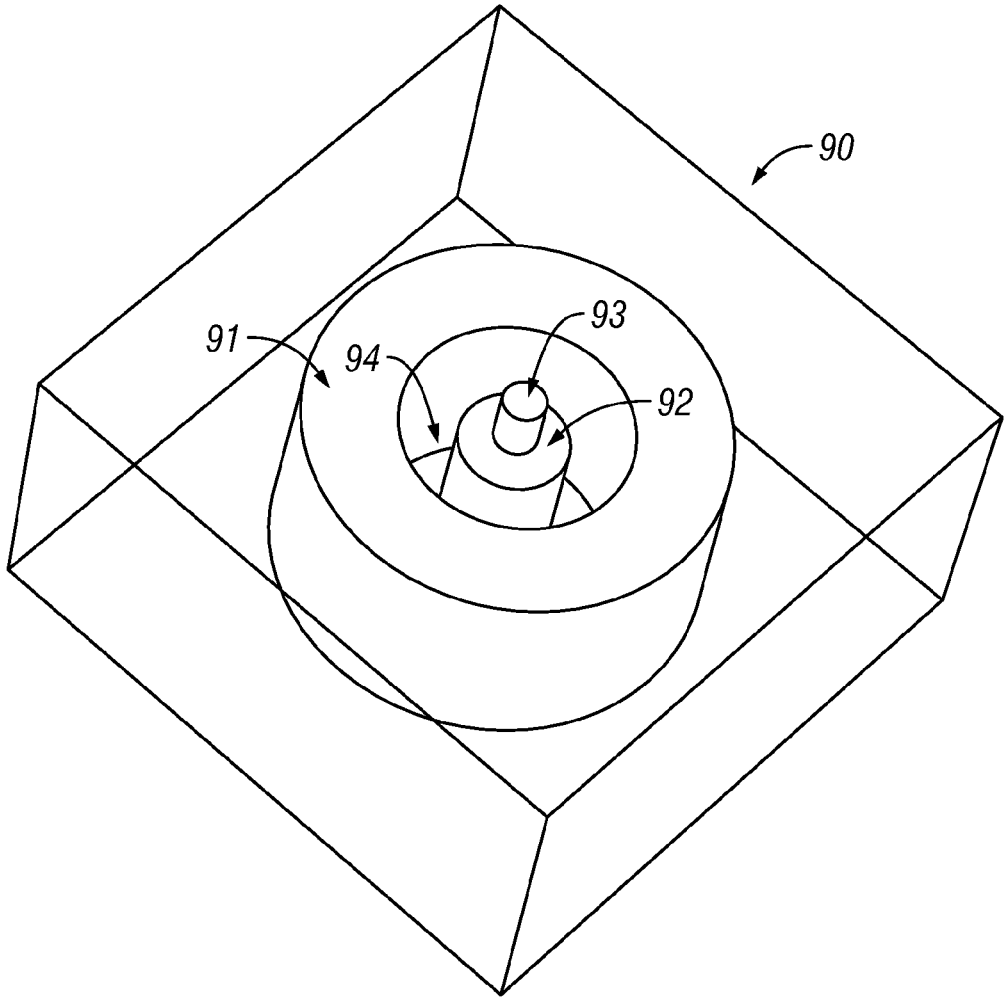

A further embodiment of the resonant structure 80 for the present invention is depicted in FIG. 10*b*. As with the embodiment of FIG. 10*a* the body ceramic element 81 is of cruciform configuration. The top surfaces 82 of the arm members are again beveled, however in this example the bottom surfaces 83 of the arm members are planar. The body also includes a central void 84 with one or more curved surfaces 85. Preferably the central void includes hemispherical internal surfaces. Yet another embodiment of the resonant structure 90 for the present invention is illustrated in FIG. 10*c*. The resonant structure 90 in this example includes pair of ceramic elements 91 and 92 and conductive post 93. The body of each ceramic element in this instance is of annular configuration. All three elements of the resonant structure 90 are arranged concentrically, with the second ceramic element 92 being disposed within the central bore 94 of the first ceramic element 91 and post 93 being disposed within the central bore of the second ceramic element 92.

Figure 10D:
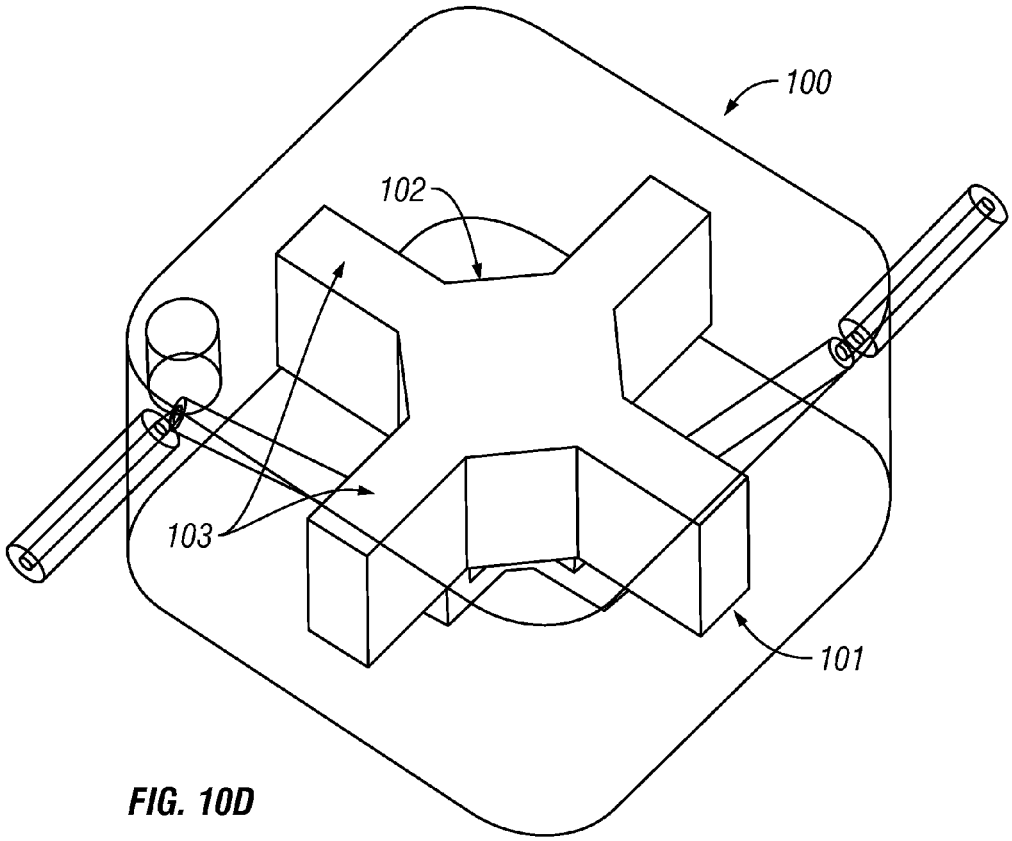

FIG. 10*d* illustrates yet another possible embodiment of the resonant structure 100 for the present invention. In this instance the resonant structure 100 includes a single ceramic element 101. The body of the ceramic element 101 is of cruciform configuration with a cubic central portion 102. The upstanding edges of the cubic central portion are aligned with the axes of the arm members 103 of the cruciform.

Figure 10E:
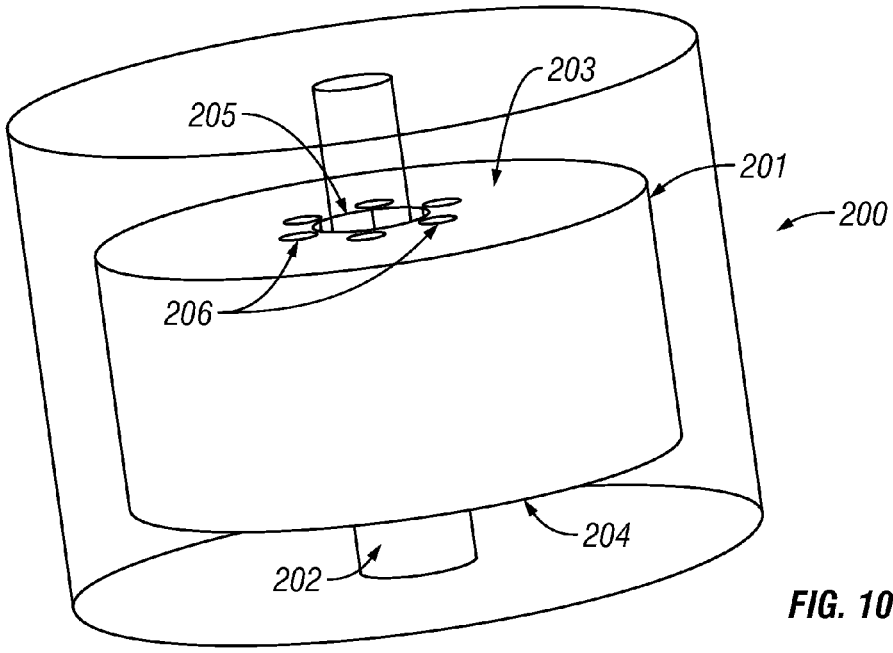

A still further embodiment of the resonant structure 200 for the present invention is shown in FIG. 10*e*. In this example the resonant structure includes a ceramic element 201 and a post 202. The body of the ceramic element 201 is of cylindrical configuration having first planar surface 203 and second planar surface 204 axially opposite to said first surface. A central bore 205 is also provide and extends from the first surface through the body of the ceramic element 201 to the second surface 203. The ceramic also includes a series of recesses 206 disposed on the first surface about the central bore 205. Post 202 is positioned within central bore 205 and extends outwardly from said second surface 203. Unlike the above embodiments the post in this case is constructed from a non-conductive material.

In addition to the above filter types, the applicant has realized that there is a need more complicated filters employing the present invention to be produced and this is presently the focus of their ongoing research. At present an 8 section TM filter, and a 5 section TE filter with two TM low side poles and one TM high side pole is being investigated.

It is anticipated that the size reduction of a full masthead amplifier (MHA) employing the present invention, such as the single 1900 MHz and dual 1800/1900 MHz type MHAs, could be in the order 10% and 15% respectively.

The reference to any prior art in this specification is not, and should not be taken as an acknowledgement or any form of suggestion that the referenced prior art forms part of the common general knowledge in Australia or any other country.

It is to be understood that the above embodiments have been provided only by way of exemplification of this invention, and that further modifications and improvements thereto, as would be apparent to persons skilled in the relevant art, are deemed to fall within the broad scope and ambit of the present invention described herein and defined in the following claims.

The invention claimed is:

1. A multiband filtering apparatus for use in a communications system, said apparatus including:

a housing;

a plurality of cavities disposed within said housing wherein each cavity includes a resonant structure, each resonant structure having at least one ceramic element, and at least one conductive post adjacent the ceramic element, each conductive post including a bore, and wherein said plurality of cavities are suitably dimensioned to allow for the propagation of at least two independent passbands;

at least one input port coupled to a first resonant structure of said plurality of resonant structures;

at least one output port coupled to a second resonant structure of said plurality of resonant structures;

a closure member adapted to engage said housing and cap said plurality of cavities; and a plurality of tuning rods, each tuning rod being associated with the at least one conductive post within each resonant structure such that a portion of each tuning rod is received within the bore of its associated conductive post; and wherein at least one passband is propagated as a TM01δ mode and at least one passband is propagated as a TE01δ mode.

2. The multiband filtering apparatus of claim 1 wherein the resonant structures are positioned centrally within a respective cavity.

3. The multiband filtering apparatus of claim 1 wherein at least one of the resonant structures is a multimode resonator.

4. The multiband filtering apparatus of claim 1 wherein each ceramic element has a configuration selected from any of an annular, toroidal, or cylindrical configuration.

5. The multiband filtering apparatus of claim 1 wherein each ceramic element is in the form of a puck.

6. The multiband filtering apparatus of claim 5 wherein each puck rests directly on its respective cavity's floor.

7. The multiband filtering apparatus of claim 5 wherein each puck is mounted on a support provided within the respective cavity.

8. The multiband filtering apparatus of claim 5, wherein the TE01δ mode is used within each puck.

9. The multiband filtering apparatus of claim 1, wherein each conductive post extends upwardly from its respective cavity's floor and terminates adjacent its respective cavity's rim.

10. The multiband filtering apparatus of claim 1 wherein said input port and said output port are provided on opposite sides of the housing.

11. A multiband filtering apparatus having a first filtering path and second filtering path, said apparatus including:

a housing;

a first set of cavities disposed within said housing;

a first set of resonant structures wherein each of the resonant structures of first set of resonant structures are disposed within a respective cavity from said first set of cavities, each of said first set of resonant structures including at least one ceramic element;

a second set of cavities disposed within said housing;

a second set of resonant structures wherein each of the resonant structures of said second set of resonant structures are disposed within a respective cavity form said second set of cavities;

a second input port coupled to a first resonator from said second set of resonators resonant structures;

a second output port coupled to a second resonator from said second set of resonators resonant structures; and wherein both the first and second sets of cavities are suitably dimensioned to allow the propagation of at least two independent passbands and whereby the first filtering path is provided through the first set of resonant structures; and the second filtering path is provided through the second set of resonant structures and at least one resonant structure from said first set of resonant structures.

12. The multiband filtering apparatus of claim 11 wherein the input port and the output port are either co-axial couplings or waveguide couplings.

13. The multiband filtering apparatus of claim 11 wherein the housing, a closure member and at least one cavity of said first and second set of cavities are formed from a conductive material.

14. The multiband filtering apparatus of claim 11 wherein:

the first filtering path is provided through the first set of resonant structures; and the second filtering path is provided through the second set of resonant structures and at least one resonant structure from said first set of resonant structures.

15. The multiband filtering apparatus of claim 11 wherein the first set of cavities and the second set of cavities are coupled together.

16. The multiband filtering apparatus of claim 11 further including a tuning arrangement for coupling multiple cavities, the tuning arrangement including a floating disk and adjustment rod.

17. The multiband filtering apparatus of claim 16 wherein the floating disk is formed from metal and the adjustment rod is a non-conductive threaded rod.

18. The multiband filtering apparatus of claim 11 wherein at least one of the resonant structures from said first set and/or said second set of resonant structures is a multimode resonator.

19. The multiband filtering apparatus of claim 11 wherein each ceramic element has a configuration selected from annular, toroidal, or cylindrical.

20. The multiband filtering apparatus of claim 11 wherein each ceramic element is in the form of a puck.

21. The multiband filtering apparatus of claim 20 wherein each puck rests directly on its respective cavity's floor.

22. The multiband filtering apparatus of claim 20 wherein one or more of the pucks may be mounted on a support provided within a respective cavity.

23. The multiband filtering apparatus claim 20, wherein a TE01δ mode is used within the pucks.

24. The multiband filtering apparatus of claim 11 wherein at least one passband is propagated as a TE01δ mode and at least one passband is propagated as a TE01δ mode.

25. The multiband filtering apparatus of claim 11 wherein at least one of the resonant structures from the second set of resonant structures is a comb-line resonator.

26. The multiband filtering apparatus of claim 11 wherein each conductive post extends upwardly from its respective cavity's floor and terminates adjacent its respective cavity's rim.

27. The multiband filtering apparatus of claim 11 wherein one or more of the posts terminates a predetermined distance from its respective cavity's rim.

* * * * *